United States Patent [19]

Schuster et al.

[11] 4,287,716

[45] Sep. 8, 1981

[54] EXHAUST GAS SYSTEM FOR INTERNAL COMBUSTION ENGINES

[75] Inventors: Hans-Dieter Schuster, Schorndorf; Karl Jans, Wendlingen; Rolf Ohlendorf, Weinstadt, all of Fed. Rep. of Germany

[73] Assignee: Daimler-Benz Aktiengesellschaft, Stuttgart, Fed. Rep. of Germany

[21] Appl. No.: 127,448

[22] Filed: Mar. 5, 1980

[30] Foreign Application Priority Data

Mar. 30, 1979 [DE] Fed. Rep. of Germany ..... 2912796

[51] Int. Cl.[3] ..... F01N 3/15; F02D 17/00

[52] U.S. Cl. ..... 60/276; 60/288; 60/301; 123/198 F

[58] Field of Search ..... 60/274, 301, 276, 288; 123/198 F

[56] References Cited

U.S. PATENT DOCUMENTS

| | | | |
|---|---|---|---|
| 3,708,980 | 1/1973 | Truxell | 60/301 |
| 3,984,975 | 10/1976 | Price | 60/301 |
| 4,107,921 | 8/1978 | Iizuka | 123/198 F |
| 4,245,471 | 1/1981 | Sugasawa | 60/301 |

*Primary Examiner*—Douglas Hart
*Attorney, Agent, or Firm*—Craig and Antonelli

[57] ABSTRACT

An exhaust gas system for a multi-cylinder internal combustion engine, in which some cylinders are adapted to be effectively disconnected; the exhaust gas system includes in a common exhaust line, an $O_2$-probe and two series-connected catalysts while a separate exhaust gas line is coordinated to the cylinders adapted to be effectively disconnected; a control member operable as a function of load opens three separate branch connections from the separate exhaust line to the common exhaust line in such a manner that when all cylinders are firing, the branch connection terminating upstream of the $O_2$-probe is opened; the branch terminating in the common exhaust line between the $O_2$-probe and the first of the series-connected catalysts is opened when at least one of the cylinders is effectively disconnected and when the internal combustion engine is still relatively cold or warms up to a middle temperature; at temperatures exceeding the middle operating temperature, the branch connection terminating between the two catalysts is opened.

6 Claims, 1 Drawing Figure

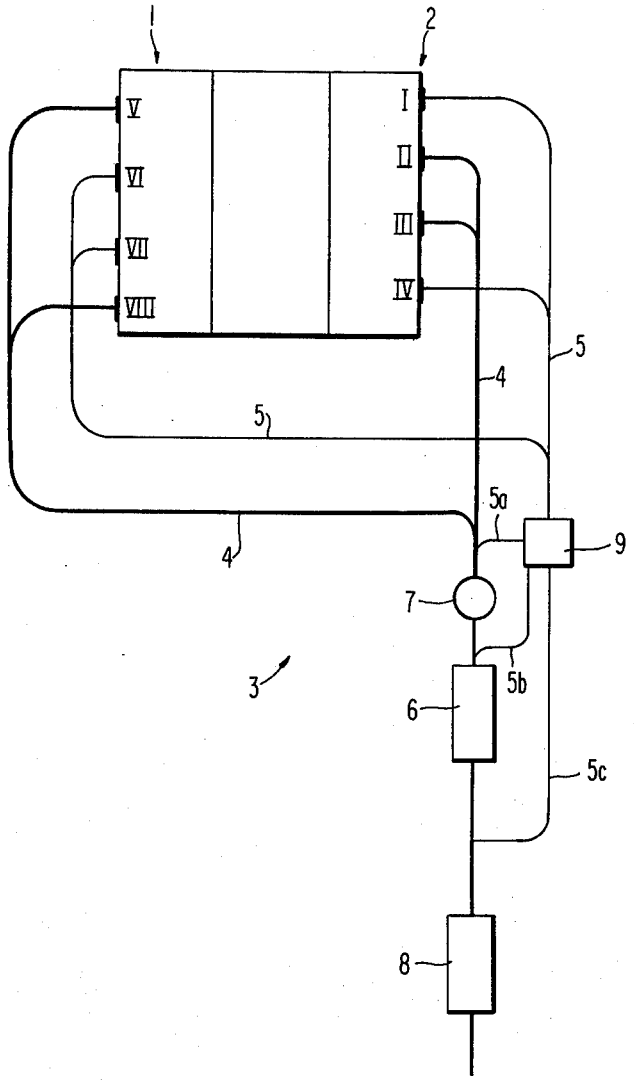
1
2
V
VI
VII
VIII
I
II
III
IV
5
4
5
5a
9
4
7
3
5b
6
5c
8

EXHAUST GAS SYSTEM FOR INTERNAL COMBUSTION ENGINES

The present invention relates to an exhaust gas system with an $O_2$-probe and with two series-connected catalysts downstream of the $O_2$-probe for a preferably eight-cylinder internal combustion engine with a V-arrangement of the cylinder rows.

The future fuel consumption regulations, especially in the United States, force in connection with large volumetric internal combustion engines, the adoption of special measures reducing the fuel consumption. Simultaneously therewith higher requirements are placed upon the exhaust gas decontamination systems by legally prescribed exhaust gas standards and testing methods. The present invention is therefore concerned with the task to provide a high-power exhaust gas system for large volumetric internal combustion engines, by means of which permissive harmful component concentrations in the exhaust gases can still be maintained in the coming years under each operating condition of the internal combustion engine also with more strict exhaust gas regulations.

To solve the underlying problem the present invention provides an exhaust gas system for an internal combustion engine which is adapted to be rendered inoperable at least with respect to one-cylinder and in which a separate exhaust gas line is coordinated to the cylinders adapted to be effectively disconnected which includes three separate branch connections to the common exhaust line that are so controlled that when all cylinders are operable, the connection that terminates upstream of the $O_2$-probe is opened, and the connection terminating between the $O_2$-probe and the catalyst arranged downstream thereof is opened when at least one cylinder is effectively disconnected and the internal combustion engine is still relatively cold while the connection terminating between the two catalysts is opened when the temperature exceeds a middle operating temperature.

The problems as regards the maintenance of the permissive harmful component concentrations is eliminated by the measures according to the present invention, especially with internal combustion engines having a cylinder disconnection and a catalytic exhaust gas decontamination system as well as a controlled mixture preparation. The fuel air/fuel mixture of $\lambda=1$, which is a prerequisite for an optimum exhaust gas decontamination without additional fuel consumption deterioration, is at least approximately attained by the separate exhaust gas lines and by the aimed-at exhaust gas conduction.

Accordingly, it is an object of the present invention to provide an exhaust gas system for a multi-cylinder internal combustion engine with at least one disconnectible cylinder, which avoids by a simple means the aforementioned shortcomings and drawbacks encountered in the prior art.

Another object of the present invention resides in an exhaust gas system for multi-cylinder internal combustion engines, especially large volumetric internal combustion engines, which is capable of meeting the higher requirements as regards exhaust gas decontamination and fuel consumption that are expected of such engines in the future.

A further object of the present invention resides in an exhaust gas system for an internal combustion engine of the type described above, in which the problems as regards maintenance of permissive harmful component concentrations is effectively eliminated while a mixture ratio of air/fuel of $\lambda=1$ is at least approximately attained by a simple means.

These and other objects, features and advantages of the present invention will become more apparent from the following description when taken in connection with the accompanying drawing which shows, for purposes of illustration only, one embodiment in accordance with the present invention, and wherein:

The single figure is a schematic view of an eight-cylinder internal combustion engine with V-arrangement of the two-cylinder rows and equipped with an exhaust gas system in accordance with the present invention.

Referring now to the single figure of the drawing, an eight-cylinder internal combustion engine with a V-arrangement of the cylinder rows generally designated by reference numeral 1 and reference numeral 2 and with a cylinder disconnection of any known type is provided with an exhaust gas system generally designated by reference numeral 3 which is composed of two separately arranged exhaust gas lines 4 and 5. The exhaust gas line 4 is connected with the cylinders II and III of the right cylinder row 2 as well as with the cylinders V and VIII of the left cylinder row 1 which cannot be disconnected or rendered inoperable whereas the exhaust gas line 5 is operatively connected with the cylinders I and IV of the right cylinder row 2 and with the cylinders VI and VII of the left cylinder row 1 which are adapted to be effectively disconnected, i.e. rendered inoperable to fire by conventional means. The exhaust gas line 4 is equipped with a selectively operable catalyst 6. An $O_2$-probe 7 is series-connected upstream of the catalyst 6 through which exhaust gases are conducted continuously during the operation of internal combustion engine. The fuel/air ratio is controlled by means of the $O_2$-probe 7 by way of an electronic control unit (not shown) of conventional construction. A second catalyst 8 is arranged in series with and downstream of the catalyst 6, which second datalyst 8 operates as pure oxidation catalyst when cylinders are disconnected, or as three-way catalyst during eight-cylinder operation of the engine.

Three line sections 5*a*, 5*b* and 5*c* branch off as connections from the exhaust gas line 5 coordinated to the cylinders adapted to be effectively disconnected, of which the line section 5*a* terminates ahead of the $O_2$-probe 7, line section 5*b* between the $O_2$-probe 7 and the first catalyst 6, and the line section 5*c* between the first catalyst 6 and the second catalyst 8. A control element 9 which is dependent on the operating temperature of the internal combustion engine, for example, on the cooling water-, oil-or exhaust gas temperature, and which is of any conventional construction, is additionally interconnected into the branching of the exhaust gas line 5; the control element 9—depending on the number of fired cylinders and on the operating condition of the internal combustion engine—thereby interconnects the line section 5*a*, 5*b* or 5*c*, but never interconnects two or three line sections simultaneously.

The line section 5*a* is connected in the base connection, i.e. when all cylinders are firing, that is during eight-cylinder operation at higher output requirements. All three harmful components, namely hydrocarbons (HC), carbon monoxide (CO) and nitrogen oxides ($NO_x$), are conducted by way of the $O_2$-probe 7 and through the first catalyst 6 operating as three-way catalyst. The harmful components HC, CO and $NO_x$ are thereby reduced by conversion and are nearly completely converted in the series-connected catalyst 8 which operates in this case as three-way catalyst.

With four-cylinder operation and cold internal combustion engine, the line section 5*b* interconnected during the warm-up phase up to a middle operating temperature, for example, of about 45° C. cooling water temperature, because a controlled operation with $\lambda=1$ is not possible during the warm-up phase. The selectively operable catalyst 6 now operates as oxidation catalyst since air is pumped through the exhaust gas line 5 when the four-cylinders I, IV, VI and VII are effectively disconnected or rendered inoperable, i.e. when the four-cylinders I, IV, VI and VII only pump air. As a result of this connection, the catalyst 6 becomes operable more rapidly. When the middle operating temperature is exceeded, the line section 5*c* is then interconnected and the catalyst 6 again operates as three-way catalyst, i.e. without air excess, and the catalyst 8 operates as oxidation catalyst.

Separate exhaust gas installations are also analogously applicable in connection with such internal combustion engines, in which the cylinders I, IV, VI and VII are fired constantly during driving operation.

While we have shown and described only one embodiment in accordance with the present invention, it is understood that the same is not limited thereto but is susceptible of numerous changes and modifications, as known to those skilled in the art, and we therefore do not wish to be limited to the details shown and described herein but intend to cover all such changes and modifications as are encompassed by the scope of the appended claims.

We claim:

1. An exhaust gas system for a multi-cylinder internal combustion engine, comprising several cylinder means, a common exhaust line means operatively connected with predetermined cylinder means and including an $O_2$-probe means and two catalyst means series-connected downstream of the $O_2$-probe, characterized in that at least one cylinder means is adapted to be effectively disconnected, and in that a separate exhaust gas line means is coordinated to the cylinder means adapted to be effectively disconnected, said separate exhaust gas line means including three separate line connections leading to the common exhaust line means, and load dependent control means for opening a respective one of said line connections in such a manner that when all cylinder means are effectively connected and operate as internal combustion engine, the line connection terminating in the common exhaust line means upstream of the $O_2$-probe means is opened, that with at least one cylinder means effectively disconnected and with a cold internal combustion engine up to a middle operating temperature, the line connection terminating in the common exhaust gas line means between the $O_2$-probe means and the catalyst means arranged downstream thereof is opened, and that the line connection terminating in the common exhaust gas line means between the two catalyst means is opened when the temperature of the engine exceeds the middle operating temperature.

2. An exhaust gas system according to claim 1, characterized in that the internal combustion engine includes a V-arrangement of its cylinder rows.

3. An exhaust gas system according to claim 2, characterized in that the internal combustion engine is an eight-cylinder internal combustion engine with a V-arrangement of the two-cylinder rows.

4. An exhaust gas system according to claim 1, 2 or 3, characterized in that the control means controls the line connections as a function of at least one of temperature and rotational speed.

5. An exhaust gas system according to claim 4, characterized in that the control means controls the line connections as a function of temperature and rotational speed.

6. An exhaust gas system according to claim 4, characterized in that the middle operating temperature of the internal combustion engine is of the order of 40° to 50° C. cooling water temperature.

* * * * *